US007114197B2

(12) United States Patent
Garneau et al.

(10) Patent No.: US 7,114,197 B2
(45) Date of Patent: Oct. 3, 2006

(54) ADJUSTABLE STABILIZATION STRAP APPARATUS

(75) Inventors: Louis Garneau, St-Augustin-de-Desmaures (CA); Paul Isabelle, St-Augustin-de-Desmaures (CA); Denis Gingras, St-Nicolas (CA)

(73) Assignee: Louis Garneau Sport Inc., Saint-Augustin-de-Desmaures (CA)

( * ) Notice: Subject to any disclaimer, the term of this patent is extended or adjusted under 35 U.S.C. 154(b) by 0 days.

(21) Appl. No.: 11/034,868

(22) Filed: Jan. 14, 2005

(65) Prior Publication Data

US 2006/0156448 A1 Jul. 20, 2006

(51) Int. Cl.
*A42B 7/00* (2006.01)

(52) U.S. Cl. ..... 2/421; 2/418

(58) Field of Classification Search ..... 2/421, 2/415, 417, 418, 419, 420, DIG. 11
See application file for complete search history.

(56) References Cited

U.S. PATENT DOCUMENTS 3,354,468 A * 11/1967 Bowers, Jr. ..... 2/421
4,000,520 A * 1/1977 Svendsen et al. ..... 2/418
4,885,806 A * 12/1989 Heller ..... 2/423
5,091,997 A * 3/1992 Foehl ..... 2/424
5,704,072 A 1/1998 Garneau

* cited by examiner

*Primary Examiner*—Rodney Lindsey
(74) *Attorney, Agent, or Firm*—BCF LLP; Gaétan Prince

(57) ABSTRACT

The present invention generally relates to stabilization straps, and is more specifically concerned with a helmet stabilization strap apparatus. The stabilization strap apparatus provides connectors so configured and sized as to be mountable on the helmet, and each include a first pivotal interconnecting element and a first interlocking element. The stabilization strap apparatus further includes a strap member having ends connectable to a respective connector. Each of the ends includes a second pivotal interconnecting element and a second interlocking element, such that the second pivotal interconnecting element is mountable in a pivotal connection to the first pivotal interconnecting element and the second interlocking element matingly corresponds to the first interlocking element. Each ends of the strap member is pivotable around the pivotal connection and lockable at various strap positions with respect to the connectors when the second interlocking element engages the first interlocking element.

22 Claims, 6 Drawing Sheets

ADJUSTABLE STABILIZATION STRAP APPARATUS

FIELD OF THE INVENTION

The present invention generally relates to stabilization straps. More specifically, the present invention is concerned with an adjustable stabilization strap apparatus for a helmet.

BACKGROUND OF THE INVENTION

Conventional prior art safety helmets typically worn by users practicing activities requiring head protection, such as for example cyclists, are generally domed-shaped and come in various sizes and shapes. Fastening straps are also generally required to retain the helmet more securely in position on the wearer's head. These straps form a helmet retention system and are usually mounted to the helmet and extend under the chin of the helmet wearer.

These fastening straps assist in maintaining the helmet securely attached to the wearer's head. Indeed, not only do they minimize the occurrences of vertical movement of the helmet being projected off of the wearer's head, but they also generally help to minimize the occurrences where the helmet is pivoted off of the front or rear portion of the wearer's head.

However, such fastening straps may not always prevent a pivotal play toward the front of the wearer's head since the position of the straps holding the helmet extends under the chin. This potential pivotal play may result in exposing the back of the wearer's head, which may be hazardous during a multiple-impact fall.

In U.S. Pat. No. 5,704,072 issued in 1994 to Garneau and entitled "Occipital retention strap for cyclist headgear", the presented helmet is provided with an adjustable and removable retention strap assembly which contours the occipital portion of the wearer's head. This retention strap assembly mountable to the helmet using for example Velcro™. However, this retention strap assembly may not ensure the symmetry in positioning the strap with respect to the helmet and may not ensure the positioning repeatability of the strap to the helmet because no pre-determined attachment positions are defined on the Velcro™ area. Further, the retention strap assembly must generally be completely removed from the helmet to be repositioned at a specific location with respect to the helmet.

OBJECTS OF THE INVENTION

An object of the present invention is therefore to provide an adjustable stabilization strap apparatus.

SUMMARY OF THE INVENTION

More specifically, in accordance with the present invention, there is provided a helmet stabilization strap apparatus, comprising connectors and a strap member. The connectors are so configured and sized as to be mountable on the helmet, each connector including a first pivotal interconnecting element and a first interlocking element. The strap member has ends connectable to a respective connector, each of these ends including a second pivotal interconnecting element and a second interlocking element. The second pivotal interconnecting element is mountable in a pivotal connection to the first pivotal interconnecting element, and the second interlocking element matingly corresponds to the first interlocking element. In this manner, each end of the strap member is pivotable around the pivotal connection and lockable at various strap positions with respect to the connectors when the second interlocking element engages the first interlocking element.

The present invention also relates to a connection assembly between a helmet and a strap comprising a connector and a strap member. The connector includes a first pivotal interconnecting element and a first interlocking element. The strap member has an end including a second pivotal interconnecting element and a second interlocking element. The end of the strap member is so configured as to be mountable to the connector via a pivotal connection between the first pivotal interconnecting element and the second pivotal interconnecting element. The second interlocking element is so configured and sized as to cooperate with the first interlocking element such that the strap member is lockable to the connector at various strap positions.

The present invention is further concerned with a helmet stabilization strap apparatus comprising a pair of connectors and a strap member. The pair of connectors is mounted to the helmet and has a body including an aperture extending through this body and a lock defining locking indentations. The strap member has two opposite ends each including a key and a shaft protruding therefrom, wherein the strap member is pivotally mountable to the pair of connectors via the shaft engaging the aperture. Thus, the strap member is lockable at various strap positions with respect to the connectors when the key matingly engages one of the locking indentations.

The present invention still further relates to a helmet stabilization strap apparatus comprising a pair of connectors and a strap member. The pair of connectors is mounted on the helmet and has a body including a shaft and a key protruding from the connector. The strap member has two opposite ends, each including an aperture extending therethrough and a lock defining locking indentations, wherein the strap member is pivotally mountable to the pair of connectors via the shaft engaging the aperture. Thus, the strap member is lockable at various strap positions with respect to the connectors when the key matingly engages one of the locking indentations.

The foregoing and other objects, advantages and features of the present invention will become more apparent upon reading of the following non-restrictive description of illustrative embodiments thereof, given by way of example only with reference to the accompanying drawings.

DETAILED DESCRIPTION

Generally stated, the present invention relates to a helmet stabilization strap apparatus which is pivotable when mounted to a helmet, such as for example, a cyclist helmet, and which is adjustable and lockable to more than one predetermined angled position with respect to the helmet.

Figure 1:
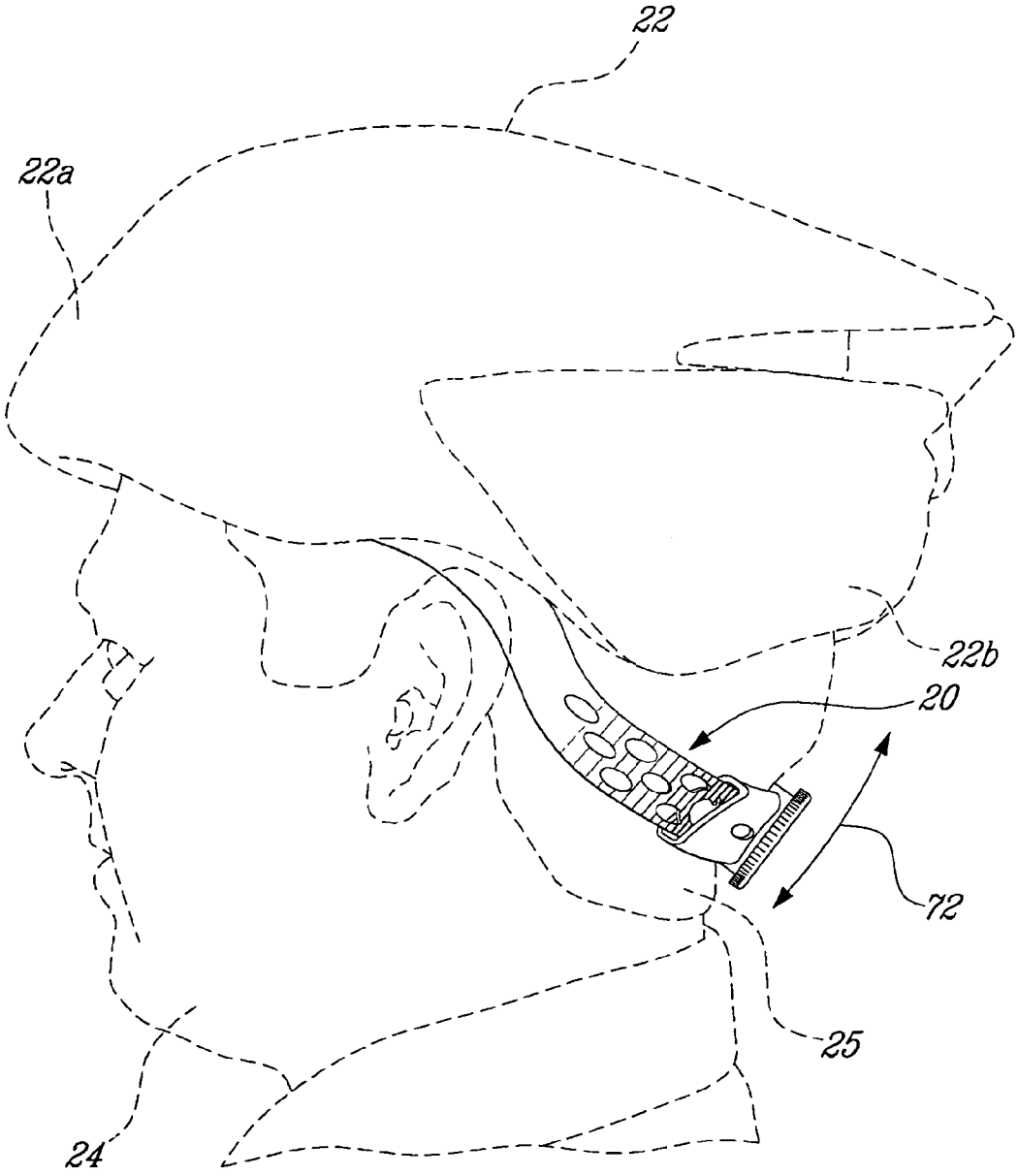
FIG. 1 is a perspective view of a stabilization strap apparatus mounted to a helmet worn by a cyclist according to an illustrative embodiment of the present invention.
Figure 2:
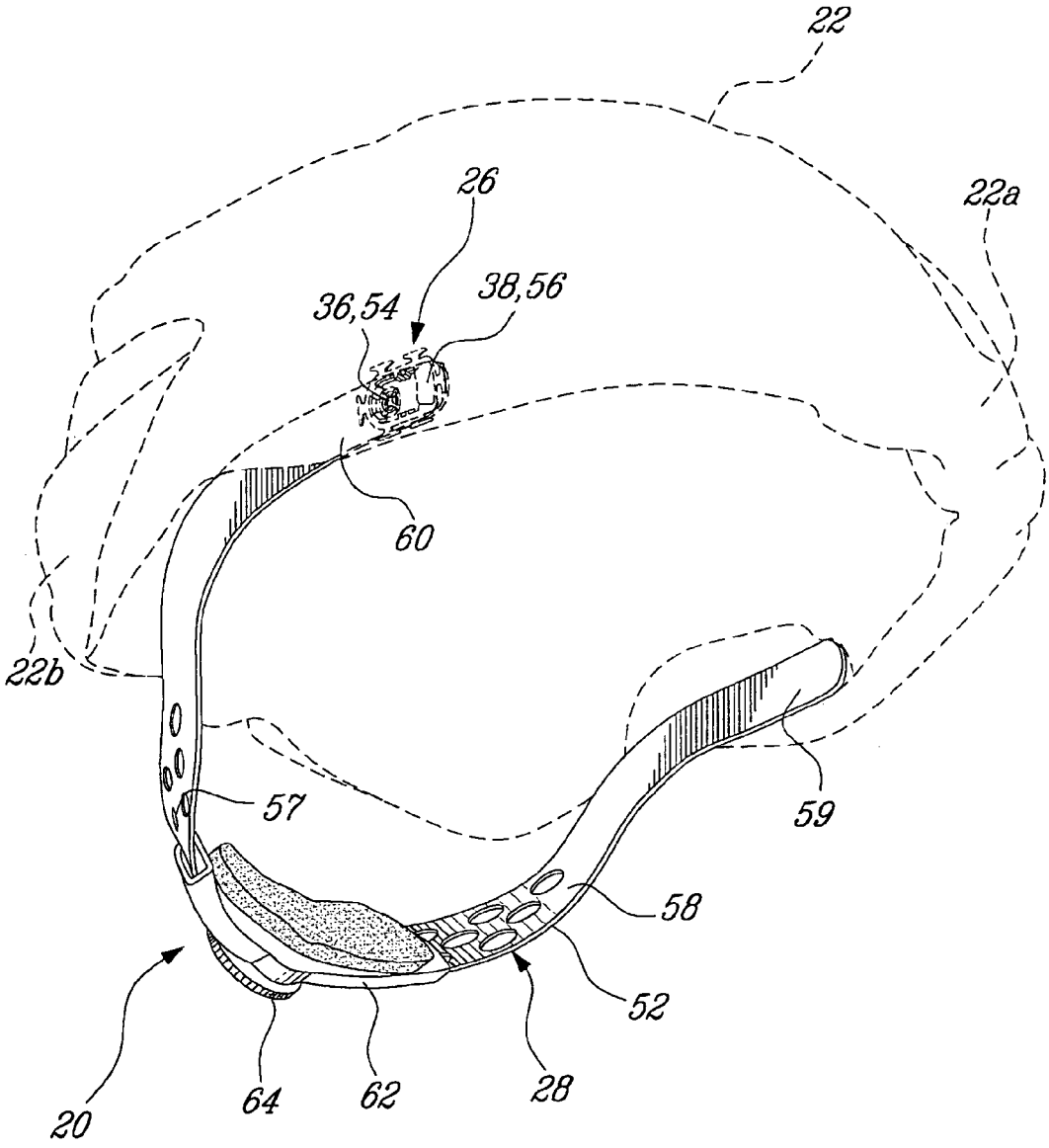
FIG. 2 is an upward perspective view of the stabilization strap apparatus shown in FIG. 1.

As shown in FIGS. 1 and 2, a stabilization strap apparatus 20 is so configured as to be mountable on a helmet 22 worn by a user 24, such as for example a cyclist, and to generally extend in the vicinity of the occipital head portion 25 of the user 24, to help maintain the position of the helmet 22.

The stabilization strap apparatus 20 generally includes connectors 26 (only one shown in FIG. 2) and a strap member 28 having opposite ends.

Figure 3:
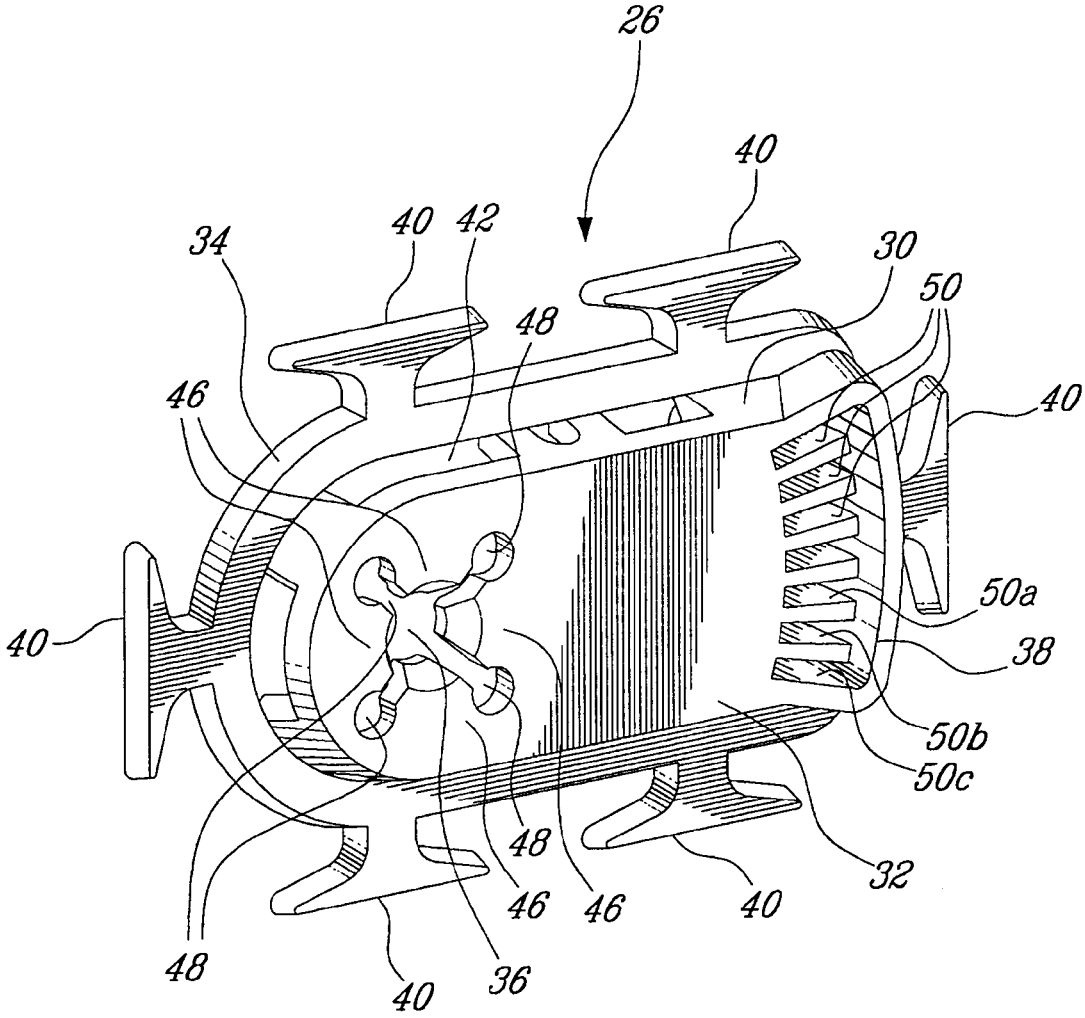
FIG. 3 is a detail perspective view of a connector used in the stabilization strap apparatus shown in FIG. 1.

One connector 26 is shown in more details in FIG. 3. The connector 26 has a body 30 including a head wall 32 and a helmet wall 34, and includes a pivotal interconnecting element, such as for example an aperture 36, and an interlocking element, such as for example a lock 38.

The connector 26 is generally a molded part, such as for example, a plastic molded part. In the illustrative embodiments, the connector 26 includes six legs 40 extending outwardly from the helmet wall 34. The legs 40 are so configured as to connect with corresponding receiving portions (not shown) on the helmet 22.

Figure 5:
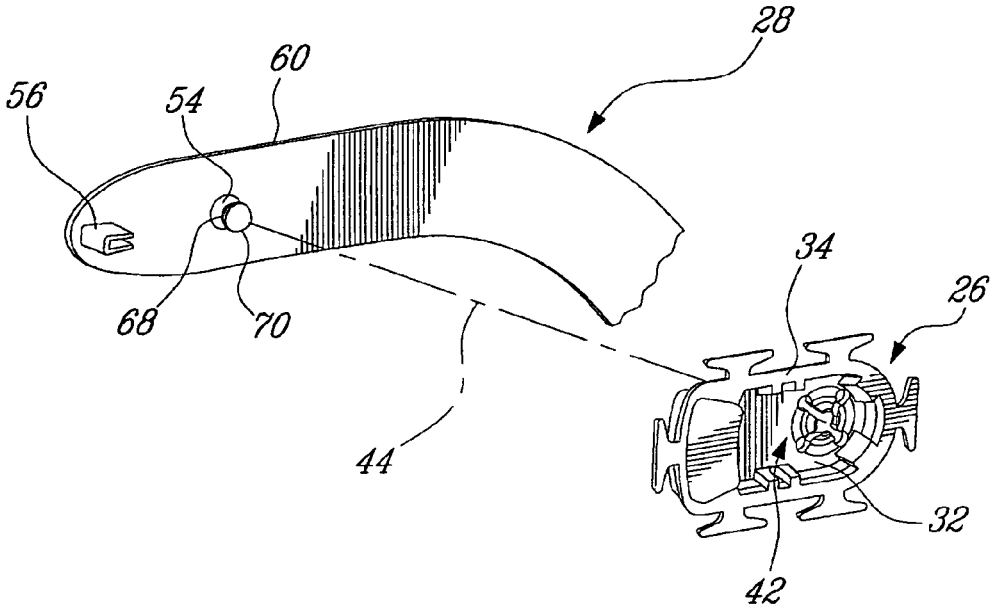
FIG. 5 is another partial perspective and exploded view of elements included in the stabilization strap apparatus.

The head wall 32 is generally the portion of the body 30 which faces the head of the user, and the helmet wall 34 is generally the portion of the body 30 which opposes the head of the user. In the illustrative embodiment, the head wall 32 and the helmet wall 34 are generally spaced apart, forming a chamber 42 therebetween as illustrated in FIGS. 3 and 5.

The aperture 36 generally opens to the chamber 42 and is so configured and sized as to cooperate in a pivotal connection with the strap member 28, generally along a pivotal axis (44 in FIGS. 4 and 5), as will be further described hereinbelow.

In the illustrative embodiment of FIG. 3, four deformable lip portions 46 are defined by four channels 48 extending through the head wall 32 from the aperture 36. The channels 48 generally help to improve the flexibility of the connector 26 during the assembly and disassembly of the strap member 28, by allowing the deformable lip portions 46 to deform under a pushing or pulling force, as will be further explained hereinbelow. Optionally, the deformable lip portions 46 further taper down from the head wall 32 and along the aperture 36 to ease the assembly process between the strap member 28 and the connector 26.

The lock 38 generally extends in the body 30 and includes a plurality of locking indentations 50 that altogether define a plurality of locking connections for the strap member 28, as will be further described hereinbelow. For instance, in the illustrative embodiment, consecutive locking indentations 50*a*, 50*b* define one possible locking connection.

Figure 4:
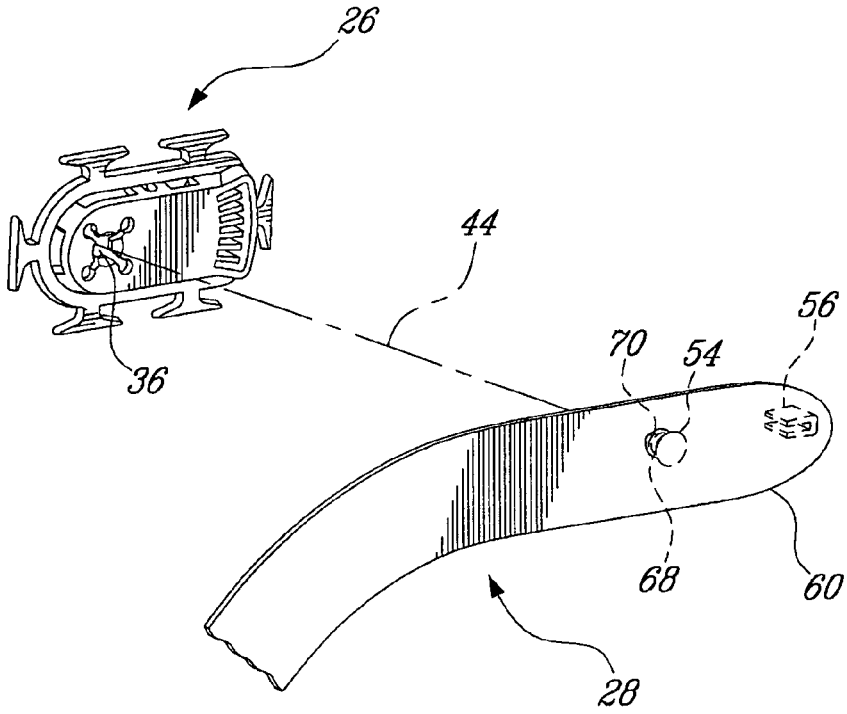
FIG. 4 is a partial perspective and exploded view of elements included in the stabilization strap apparatus shown in FIG. 1.

The strap member 28 is shown in more details in FIGS. 2, 4 and 5. The strap member 28 includes a strap body 52, pivotal interconnecting elements, such as for example shafts 54 (only one shown), and interlocking elements, such as for example keys 56 (only one shown).

The strap body 52 is generally an assembly of formed, machined or molded parts, such as for example plastic parts, so configured and sized as to be attached at its ends to the helmet (22 in FIG. 1) via the connectors 26.

In the illustrative embodiment illustrated herein, the strap body 52 includes two strap portions 57, 58 and two opposite ends 59, 60. The strap portions 57, 58 are linked to one another by an adjusting assembly 62 that generally provides the means to bring the strap portions 57, 58 closer together or farther away from each other by operating an actuating mechanism 64 to adjust to the particular wearer's head size. Since such adjusting assemblies are believed well known in the art, it will not be further discussed herein.

The end 60 of the strap member 28 is illustrated in more details in FIGS. 4 and 5, where the shaft 54 and the key 56 are shown near the end 60 of the strap member 28. In the illustrative embodiment, the shaft 54 and the key 56 protrude from the end 60 in such a way as to allow the pivotal connection of the end 60 to the connector 26 and a locking connection between the end 60 and the connector 26, as will be further explained hereinbelow.

The shaft 54 is generally so configured and sized as to matingly cooperate with the aperture 36 of the connector 26 along the pivotal axis 44. As better shown in the illustrative embodiment of FIG. 5, the shaft 54 includes a pin 68 and a knob portion 70.

The knob portion 70 generally terminates the shaft 54 since it is separated from the strap member 28 by the pin 68. The dimensional configuration of the knob portion 70, such as for example its diameter, is generally larger than that of the pin 68 and that of its corresponding aperture 36. The dimensional configuration of the pin 68 is generally equal or slightly smaller than that of the corresponding aperture 36. The dimensional configuration of the pin 68 and of the knob portion 70 are generally designed to securely and removably allow the pivotal connection between the strap member 28 and the connector 26, such as for example in a snap-in, snap-out type of connection, as will be further explained hereinbelow.

In the illustrative embodiment, the key 56 is a U-shaped projection so configured and sized as to matingly engage or as to matingly correspond in a generally lockable cooperation with the locking indentations 50 of the connector 26, in order to maintain the selection of a relative angular position between the connector 26 and the strap member 28.

In the illustrative embodiment of FIGS. 1 to 6, the pivotal connection between the aperture 36 and the shaft 54 is located between the locking connection (the lock 38 and the key 56) and the portion of the strap body 52 which extends in the vicinity of the occipital head portion 25. The locking connection (the lock 38 and the key 56) is therefore located closer to the most extreme point of the end 60 of the strap member 28 than the pivotal connection (the aperture 36 and the shaft 54).

In operation, the stabilization strap apparatus 20 is pivotable to provide angular position adjustability of the strap member 28 with respect to the connector 26. Furthermore, the strap member 28 is lockable with respect to the connector 26 once the desired angular position has been reached.

Figure 6:
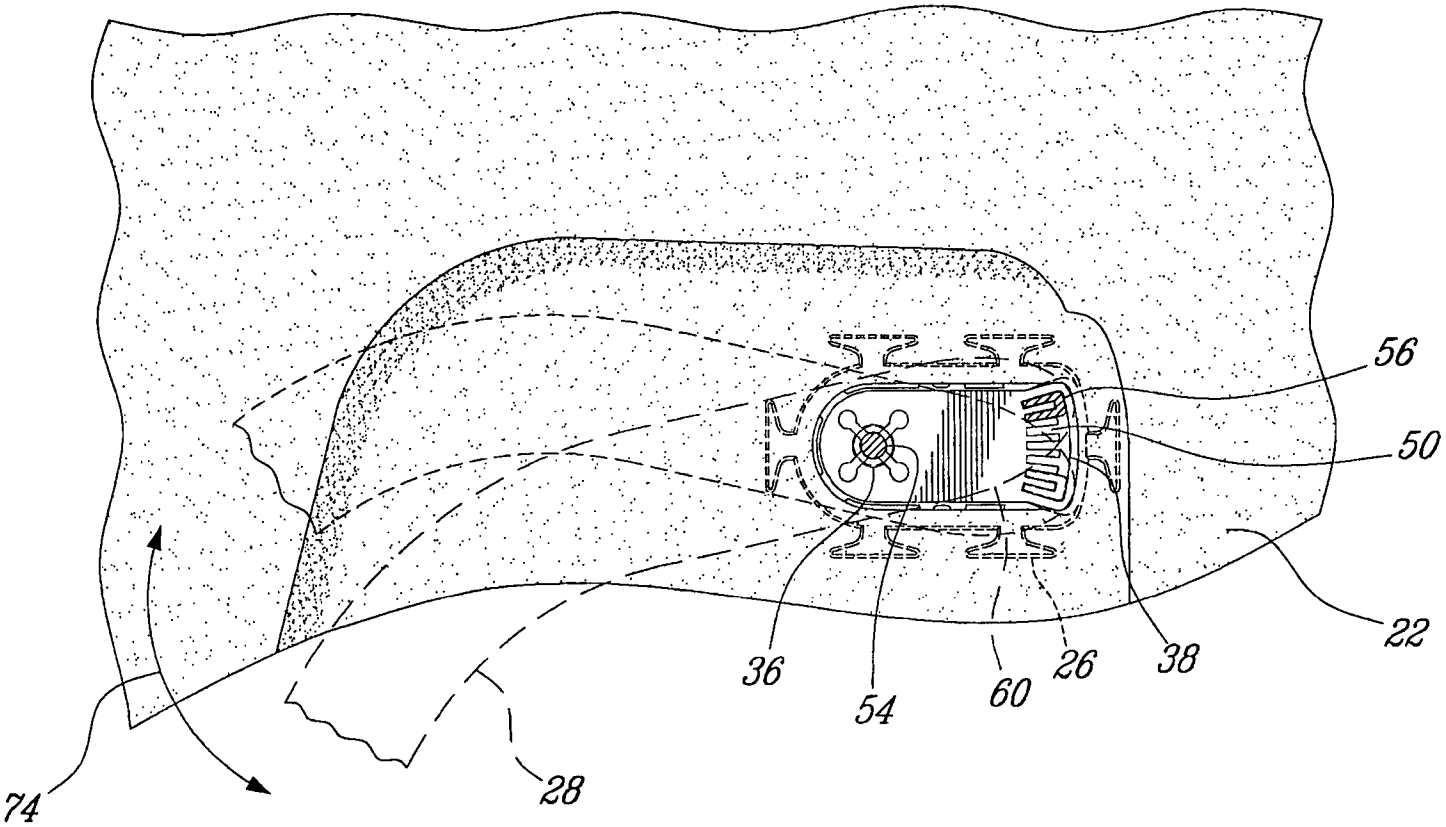
FIG. 6 is a partial side elevation view of the stabilization strap apparatus shown in FIG. 1, illustrating the pivotal capacities of the stabilization strap.

When mounted to a helmet 22, the stabilization strap apparatus 20 is therefore adjustable with respect to the head of the user and to the helmet 22, as illustrated in FIGS. 1, 2 and 6. The steps for adjusting the stabilization strap apparatus 20 will now be discussed in more details.

The strap member 28 generally first needs to be mounted to the connector 26, by inserting the shaft 54 of each ends 59, 60 inside the aperture 36 of a respective connector 26 and generate the pivotal connection thereby. As shown in the illustrative embodiment of FIGS. 3, 4, and 5, the shaft 54 may be forced in the aperture 36 toward the chamber 42 such that the knob portion 70 pushes on the lip portions 46, which in turn deform due to its elastic deformation capacities and/or due to the channels 48.

The shaft 54 is generally pushed in until the dimensions of the aperture 36 become large enough to let the knob portion 70 pass the head wall 32. At that time, the lip portions 46 generally resiliently go back to their initial configuration such that the knob portion 70 become imprisoned in the chamber 42, such that the pin 68 remains free to rotate in the aperture 36 and such that the shaft 54 and aperture 36 are assembled in a pivotal connection.

The ends 59, 60 (only 60 is shown in FIGS. 4 and 5) of the strap member 28 are thus assembled to a respective connector 26 so as to provide positional adjustability, such as for example angular adjustability (see arrow 72 in FIG. 1), between the strap member 28 and the connector 26.

Once the strap member 28 is free to pivot around its pivotal connection (see arrow 74 in FIG. 6) to the connectors 26 and when the desired angular orientation between the strap member 28 and the connectors 26 has been selected, the locking connection is made by first positioning the key 56 of the strap member 28 adjacent to and generally in-line with the locking indentations 50 that correspond to the desired angular orientation. The key 56 is then generally inserted in the facing indentations 50 of the lock 38 to matingly engage therewith.

If the strap member 28 is made from a generally flexible and resilient material, the end 60 may be bent away from the connector 26, near where the key 56 is located, to allow the strap to pivot.

Alternatively, if the selected material of the strap member 28 is flexible and/or strong enough to sustain various types of assembly loads, the hereinabove described locking connection between the lock 38 and the key 56 may be made before or simultaneously as the hereinabove described pivotal connection between the aperture 36 and the shaft 54 is made.

Once installed, the strap member apparatus 20 may further be adjusted to another angular position with respect to the connector 26 by reversing the above described steps and starting over.

Alternatively, if the strap member 28 is made from a generally flexible and resilient material, only the locking connection between the lock 38 and the key 56 may be disengaged, by forcing the lock 38 and the key 56 away from each other to modify the angle position of the strap.

One skilled in the art will easily understand that the stabilization strap apparatus 20 described hereinabove may include various alternatives.

For instance, the material, the size and the shape of the connector 26 may vary according to other manufacturing processes and to the helmet 22 for which it is designed to be installed on. The body 30 of the connector 26 may also be designed such that the head wall 32 and the helmet wall 34 are merged into one unitary part. In this configuration, the aperture 36 and the lock 38 are included into or extend through the body 30, and the chamber 42 may also be contained inside the body 30.

The head wall 32 and the helmet wall 34 may alternatively not be spaced from each other, but rather located on top of the other, such that the chamber 42 is an opening in the helmet wall 34.

The configuration of the attachment assembly involving the legs 40 of the connector 26 and the receiving portions (not shown) of a helmet 22 may be achieved by various types of fastening assemblies. The connector 26 may not necessitate legs 40 and be formed integral with the helmet 22, or may be partly encapsulated in a portion of the helmet 22, such as for example in the protective material inside the helmet 22. In the configuration where the connector 26 is partly encapsulated in the helmet 22, at least a portion of the head wall 32 including the aperture 36 and the lock 38 is generally not enclosed in the helmet 24.

The size and shape of locking indentations 50 and the number of locking indentations used to define the locking connection may also vary according to the configuration of the strap member 28 or the shape of the helmet 22, and according to the distance between the aperture 36 and the lock 38 and to the desired locking connection between the connector 26 and the strap member 28, in terms of assembly and disassembly.

Further to this, other shapes matingly corresponding to the locking indentations 50 and which, once engaged in the locking indentations, are able to lock the strap member 28 with respect to the connectors 26 may alternatively be used to accomplish the same positioning and locking function.

Also, when the stabilization strap assembly 20 is to be designed for a helmet 22, the helmet 22 may include recesses in the protective material to provide a clearance once the strap member 28 is installed and when it is free to pivot around its pivotal connection (see arrow 74 in FIG. 6) to the connectors 26.

A stabilization strap apparatus 120 according to a second illustrative embodiment of the present invention will now be described with respect to FIG. 7. For concision purposes, only the differences between the stabilization strap apparatus of the illustrative embodiment of FIG. 7 and the stabilization strap apparatus illustrated in FIG. 1 to 6 will be described hereinbelow.

In this second illustrative embodiment, the shaft 154 and the key 156 are positioned on the connector 126 and the aperture 136 and the lock 138 are positioned on the strap member 128. A person skilled in the art will also easily understand that any other combinations between the pivotal interconnecting elements (the aperture 136 and the shaft 154) and the interlocking elements (the lock 138 and the key 156) are possible, as long as the pivotal connection and the locking connections remain enabled and operatable.

Figure 7:
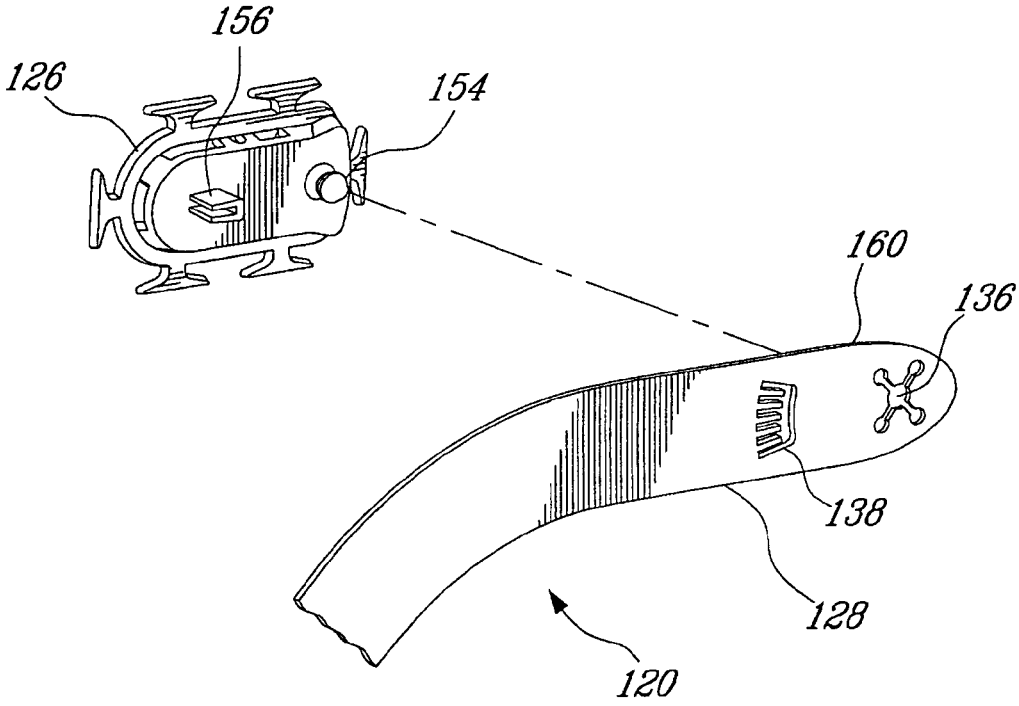
FIG. 7 is a partial perspective and exploded view showing a second illustrative embodiment of the present invention.

Also, as illustrated in FIG. 7, the shaft 154 of the connector 126 is located closer to the forward portion of the helmet (22*a* in FIG. 1) than the key 156 and the aperture 136 is located closer to the most extreme point of the end 160 than the lock 138.

In other words, the pivotal connection between the shaft 154 and the aperture 136 is located closer to the most extreme point of the end 160, or closer to the forward portion of the helmet (22*a* in FIG. 1) than the locking connection of the key 156 and the lock 138. The locking connection is located between the pivotal connection (the shaft 154 and the aperture 136) and the portion of the strap body 152 which extends in the vicinity of the occipital head portion (25 in FIG. 1).

Although the present invention has been described hereinabove by way of illustrative embodiments thereof, it can be modified, without departing from the spirit and nature of the subject invention as defined in the appended claims.

What is claimed is:

1. A stabilization strap apparatus for a helmet, comprising:

connectors so configured and sized as to be mountable on the helmet, each connector including a first pivotal interconnecting element and a first interlocking element; and a strap member having ends each connectable to a respective one of said connectors, each said ends including a second pivotal interconnecting element and a second interlocking element;

wherein:

the second pivotal interconnecting element is mountable in a pivotal connection to the first pivotal interconnecting element; and the first and second interlocking elements are of the mutually mating male/female type extending parallel to said pivotal connection, the female interlocking element defines a cavity and the male interlocking element defines a prong-like key to project in the cavity and mate with the female interlocking element at a plurality of different angular positions about the pivotal connection;

whereby each said end of said strap member is pivotable about said pivotal connection and lockable at the different angular positions about said pivotal connection when the prong-like key mates with the female interconnecting element at said angular positions.

2. A stabilization strap apparatus for a helmet as recited in claim 1, wherein said first pivotal interconnecting element is an aperture and said second pivotal interconnecting element is a shaft.

3. A stabilization strap apparatus for a helmet as recited in claim 2, wherein said connector includes a head wall, a helmet wall and a chamber, said aperture extending through said head wall and opening to said chamber for receiving said shaft.

4. A stabilization strap apparatus for a helmet as recited in claim 3, wherein said shaft includes a pin and a knob portion, said pin being pivotally mountable to said aperture while said knob portion is in said chamber.

5. A stabilization strap apparatus for a helmet as recited in claim 1, wherein said first pivotal interconnecting element is a shaft and wherein said second pivotal interconnecting element is an aperture.

6. A stabilization strap apparatus for a helmet as recited in claim 1, wherein said first interlocking element is a lock and said second interlocking element is the prong-like key.

7. A stabilization strap apparatus for a helmet as recited in claim 6, wherein said lock includes a plurality of predetermined locking connections so configured and sized as to receive said prong-like key for locking said strap member with respect to said connector.

8. A stabilization strap apparatus for a helmet as recited in 7, wherein said pre-determined locking connections are defined by a plurality of locking indentations extending in said cavity.

9. A stabilization strap apparatus for a helmet as recited in claim 8, wherein two consecutive locking indentations define one selectable locking connection.

10. A stabilization strap apparatus for a helmet as recited in claim 9, wherein said prong-like key protrudes from said strap member in a U-shaped configuration corresponding to said selectable locking connection.

11. A stabilization strap apparatus for a helmet as recited in claim 1, wherein said first interlocking element is the prong-like key and said second interlocking element is a lock.

12. A stabilization strap apparatus for a helmet as recited in claim 1, wherein the first and second pivotal interconnecting elements are of the male/female type and extend coaxial with the pivotal connection with the male interconnecting element locking in the female interconnecting element.

13. A stabilization strap apparatus for a helmet as recited in claim 12, wherein the first pivotal interconnecting element comprises an aperture, and the second pivotal interconnecting element comprises a shaft integrally formed on said end of the strap member.

14. A stabilization strap apparatus for a helmet as recited in claim 12, wherein the first pivotal interconnecting element comprises a shaft integrally formed on said connector, and the second pivotal interconnecting element comprises an aperture.

15. A stabilization strap apparatus for a helmet, comprising:

connectors so configured and sized as to be mountable on the helmet, each connector including a first pivotal interconnecting element and a first interlocking element; and a strap member having ends connectable to respective ones of said connectors, each said end including a second pivotal interconnecting element and a second interlocking element; said second pivotal interconnecting element being mountable in a pivotal connection to said first pivotal interconnecting element; said second interlocking element matingly corresponding to said first interlocking element; whereby each said end of said strap member is pivotable about said pivotal connection and lockable at different angular positions about said pivotal connection when said second interlocking element engages said first interlocking element at said angular positions;

wherein:

said first pivotal interconnecting element is an aperture and said second pivotal interconnecting element is a shaft;

each connector includes a head wall, a helmet wall and a chamber, said aperture extending through said head wall and opening to said chamber for receiving said shaft; and said head wall includes channels extending from said aperture, consecutive channels defining deformable lip portions around said aperture, said deformable lip portions being so configured as to deform under a force applied in the vicinity of said aperture upon insertion of the shaft in the opening.

16. A stabilization strap apparatus for a helmet, comprising:

connectors so configured and sized as to be mountable on the helmet, each connector including a first pivotal interconnecting element and a first interlocking element; and a strap member having ends connectable to respective ones of said connectors, each said end including a second pivotal interconnecting element and a second interlocking element; said second pivotal interconnecting element being mountable in a pivotal connection to said first pivotal interconnecting element; said second interlocking element matingly corresponding to said first interlocking element; whereby each said end of said strap member is pivotable about said pivotal connection and lockable at different angular positions about said pivotal connection when said second interlocking element engages said first interlocking element at said angular positions;

wherein:

said first pivotal interconnecting element is an aperture and said second pivotal interconnecting element is a shaft;

each connector includes a head wall, a helmet wall and a chamber, said aperture extending through said head wall and opening to said chamber for receiving said shaft;

said shaft includes a pin and a knob portion, said pin being pivotally mountable to said aperture while said knob portion is in said chamber;

said aperture has a first dimensional configuration, said pin has a second dimensional configuration that is equal or smaller than said first dimensional configuration, said knob portion has a third dimensional configuration that is larger than said first and second dimensional configurations.

17. A connection assembly between a helmet and a strap comprising:

a connector including a first pivotal interconnecting element and a first interlocking element; and a strap member having an end including a second pivotal interconnecting element and a second interlocking element;

said end of said strap member being so configured as to be mountable to said connector via a pivotal connection between said first pivotal interconnecting element and said second pivotal interconnecting element, and said first and second interlocking elements being of the mutually mating male/female type extending parallel to said pivotal connection, the female element defining a cavity and the male interlocking element defining a prong-like key to project in the cavity and mate with the female interlocking element at a plurality of different angular positions about the pivotal connection such that said strap member is lockable to said connector at said different angular positions.

18. A connection assembly as recited in claim 17, wherein said end terminates at a most extreme point of the strap member and wherein said second pivotal interconnecting element is located closer to said most extreme point than said second interlocking element.

19. A connection assembly as recited in claim 17, wherein said end terminates at a most extreme point of the strap member and wherein said second interlocking element is located closer to said most extreme point than said second pivotal interconnecting element.

20. A helmet stabilization strap apparatus, comprising:

a pair of connectors mounted to the helmet and each having a body including an aperture extending through said body and a lock defining locking indentations; and a strap member having two opposite ends, each including a prong-like key and a shaft protruding therefrom, said strap member being pivotally mountable to said pair of connectors via said shafts engaging said apertures respectively to form respective pivotal connections;

wherein the prong-like key and the lock are of the mutually male/female type extending parallel to the corresponding pivotal connection, the lock defines a cavity enclosing the locking indentations and the prong-like key is structured to project in the cavity and is mateable with the lock at a plurality of different angular positions about the pivotal connection;

whereby said strap member is lockable at the different angular positions with respect to said pivotal connections when said prong-like keys matingly engage said locking indentations at both ends of the strap member.

21. A helmet stabilization strap apparatus as recited in claim 20, wherein said connector is formed integral with the helmet.

22. A helmet stabilization strap apparatus as recited in claim 20, wherein each connector includes an enclosed portion and an open portion, said enclosed portion being partly encapsulated within the helmet and said opened portion including said aperture and said lock so configured as to receive said shaft and said prong-like key, respectively.

* * * * *